US008500497B1

(12) United States Patent
Patten

(10) Patent No.: US 8,500,497 B1
(45) Date of Patent: Aug. 6, 2013

(54) CONNECTOR DEVICE FOR JOINING MULTIPLE CONDUCTORS

(71) Applicant: Joseph W. Patten, Odessa, FL (US)

(72) Inventor: Joseph W. Patten, Odessa, FL (US)

( * ) Notice: Subject to any disclaimer, the term of this patent is extended or adjusted under 35 U.S.C. 154(b) by 0 days.

(21) Appl. No.: 13/711,211

(22) Filed: Dec. 11, 2012

(51) Int. Cl.
*H01R 11/09* (2006.01)

(52) U.S. Cl.
USPC ..... 439/784; 439/805

(58) Field of Classification Search
USPC ..... 439/427, 428, 462, 727, 778, 779, 439/784, 801, 805; 285/151.1, 342
See application file for complete search history.

(56) References Cited

U.S. PATENT DOCUMENTS 1,646,660 A * 10/1927 Prince ..... 439/805
1,710,416 A * 4/1929 Goeller ..... 439/431
1,751,572 A * 3/1930 Beemer ..... 439/784
2,279,508 A 4/1942 Bergan
3,205,472 A * 9/1965 Shannon ..... 439/764
4,141,619 A 2/1979 DeLuca
5,362,253 A 11/1994 Lin et al.
5,545,188 A * 8/1996 Bradshaw et al. ..... 607/37
5,573,423 A 11/1996 Lin et al.
6,268,565 B1 * 7/2001 Daoud ..... 174/657
7,014,513 B2 * 3/2006 Tomasino ..... 439/784
7,435,144 B2 10/2008 Waltz
7,670,197 B2 3/2010 Janulis et al.
7,976,070 B2 * 7/2011 Kiely ..... 285/151.1
8,021,184 B1 9/2011 Patten, Jr.

* cited by examiner

*Primary Examiner* — Thanh Tam Le
(74) *Attorney, Agent, or Firm* — Michele L. Lawson; Smith & Hopen, P.A.

(57) ABSTRACT

A connector device and system for joining electrical conductors is presented. The connector device is comprised generally of an elongated body having at least two tapered ends. Each tapered end has male threads disposed on the exterior surface and at least one compression groove. A compression nut having an internal taper matching the angle of the taper of the tapered end is disposed on each tapered end. In use, a conductor is inserted into one tapered end and the compression nut is rotated towards the center of the elongated body thus compressing the compression grooves and providing enhanced mechanical stability and electrical conductivity by providing 360 degree contact of the connector device with the conductor.

3 Claims, 5 Drawing Sheets

CONNECTOR DEVICE FOR JOINING MULTIPLE CONDUCTORS

FIELD OF INVENTION

This invention relates to connectors for joining conductors. Specifically, the invention provides a novel connector apparatus for joining at least 2 conductors which provides a 360 degree compression of each wire for improved mechanical and electrical connection.

BACKGROUND OF THE INVENTION

Electric cables generally consist of a conductive core (typically aluminum or copper) sometimes surrounded by insulating material. Electric cables generally can be divided into construction categories based on the type of voltage they are designed to carry. High voltages are generally those that are greater than about 50,000 volts; medium voltage are generally those that are between about 1000 volts and about 50,000 volts; and low voltage are those that are less than about 1000 volts.

In order to electrically connect two or more conductors, it is necessary to form a splice or junction between the conductors. Electrical splice connectors for connecting at least two conductors together are well known in the art. Conventional methods of splicing wires include compression and crimp style connectors. The butt-type splice is an example of a crimp style splice.

A butt-type wire connector is a splice that is used to connect wires to one another by butting their ends together inside the splice. In this type of wire connector, the wires are inserted from either end of the splice and butt against a built in wire stop. The connector is then crimped or bolted in two places, one for each wire, thus holding the wires in place. The disadvantage of this type of connector is that there is only one point of contact for electrical conduction. Additionally, there is only one point of mechanical contact thus allowing permitting the conductor to disengage from the connector.

The crimp style of splice has the disadvantage of not providing a secure mechanical connection and/or a poor electrical connection since the only contact points are at the site of the crimp or bolt. This method provides insufficient contact surface connection which affects both the mechanical and electrical connection.

An example of a compression type connector is the conventional method for splicing high voltage cable conductors. This method uses a hydraulic press which forms a compression joint to connect the ends of the conductors. This method is cumbersome, time intensive and expensive.

In light of the shortcomings of the prior art, what is needed is a new method of splicing two or more conductors together which has superior electrical conductivity, an enhanced mechanical connection, and is less expensive and less complicated than what is currently being used.

SUMMARY OF INVENTION

The present invention relates to a connector and system for joining two or more conductors. The invention comprises a connector comprised of an elongated body having at least two tapered ends. The tapered ends have male threads disposed on at least a portion of their exterior surface. The connector also has at least one compression groove that is disposed longitudinally on the exterior surface of the tapered ends.

At least one compression nut having female threads matching the male threads of the tapered end is disposed around each tapered end. The compression nut may have an internal taper that matches the angle of the taper of the tapered end to facilitate tightening the compression nut around the body of the connector.

An opening or orifice is disposed in each tapered end which leads to an internal channel. The internal channel may contain a plurality of internal ribs for gripping the conductor. Both the orifice and the internal channel are preferably sized to be slightly larger than the conductor to facilitate insertion of the conductor into the connector.

In an embodiment, the elongated body of the connector may be comprised of a center section and at least two hollow sections each of which terminate to form a tapered end. The center section of the connector may contain at least one conductor located in its interior. In an embodiment, the conductor stop is positioned substantially in the center of the center section.

The connector may be manufactured of a material such as a metal selected from the group consisting of aluminum and copper. The connector may be manufactured in various sizes and shapes to accommodate different sizes of conductors that may be used in high voltage, medium voltage or low voltage work. In addition, the connector may be manufactured to have more than two hollow sections to allow more than two conductors to be joined together.

Also presented is a system for joining electrical conductors using the connector device described previously. When the connector device is assembled, at least one compression nut is positioned so that the female threads of the compression nut are aligned with the male threads of the hollow section of the connector. Conductor is inserted into the orifice at the end of tapered end and extended into the internal channel until reaching the conductor stop. Once inserted, the compression nut is tightened towards the center section to compress the at least one compression groove together which in turn compresses the internal ribs against the conductor to provide 360 degree contact between connector and conductor. The farther down the hollow section the compression nut is screwed, the tighter the compression between the connector and the conductor. The same process is used to insert any additional conductors into the remaining tapered ends.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
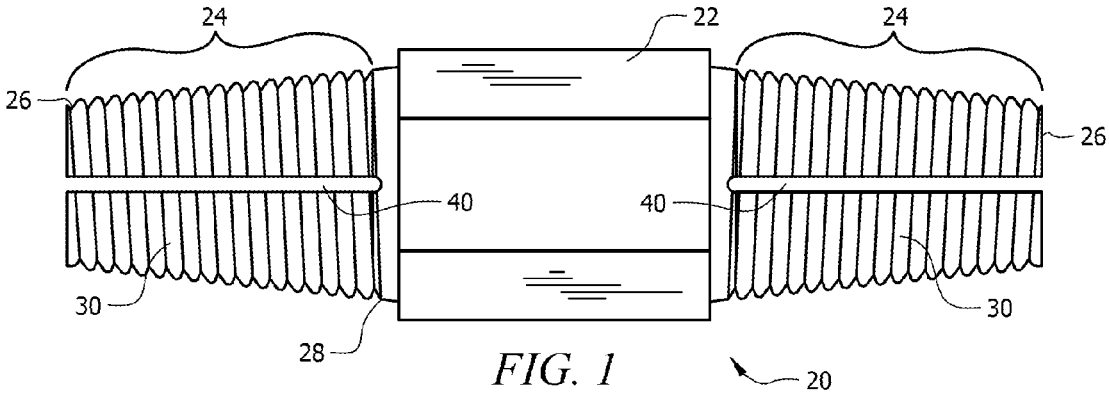
FIG. 1 is a side perspective view of the connector.

In the following detailed description of the preferred embodiments, reference is made to the accompanying drawings, which form a part hereof, and within which are shown by way of illustration specific embodiments by which the invention may be practiced. It is to be understood that other embodiments by which the invention may be practiced. It is to be understood that other embodiments may be utilized and structural changes may be made without departing from the scope of the invention.

The term "about" or "approximately" or "substantially" as used herein refers to being within an acceptable error range for the particular value as determined by one of ordinary skill in the art, which will depend in part on how the value is measured or determined, i.e. the limitations of the measurement system, including the degree of precision required for a particular purpose.

The term "conductor" as used herein refers to an electrical conductor of electricity. Examples of conductors include both non-metallic conducting compounds as well as metallic conducting materials such as a metal wire. Conductors include, but are not limited to, electrical wire, telecom wire, automotive wire, or industrial-sized wire. The conductors can be used to carry high, medium or low voltage currents depending on the circumstances of use.

The term "connector" as used herein refers to a device which connects two or more conductors together. In some embodiments, only two conductors are joined; however in other embodiments, more than two conductors may be joined. In some embodiments, there may be at least one incoming conductor that is joined to one or more outgoing conductors. In other embodiments, there may be more than one incoming conductor that is joined to one or more outgoing conductors.

Connector can be manufactured of any material known in the electrical field as being capable of conducting electricity including, but not limited to, metals such as aluminum, tin-plated aluminum, aluminum alloy, copper, copper alloy, bronze, nickel, alloys of nickel, brass, or any other suitable electrically conducting materials including non-metallic conducting materials.

The term "splice" as used herein refers to a connector which joins the ends of two or more conductors to each other. The term "splice" and the terms "joint" or "junction" are used interchangeably herein.

Although the present invention will be described with reference to the embodiments shown in the drawings, it should be understood that the present invention can be embodied in many alternate forms of embodiments. In addition, any suitable size, shape, or type of elements or materials can be used.

As depicted in FIG. 1, connector 10 is generally comprised of elongated body 20 terminating in two or more tapered ends 26. Elongated body 20 may have center section 22 from which at least two tapered hollow sections 24 extend. Each hollow section 24 tapers away from center section 22 at an angle to form a tapered end 26. Elongated body 20 may be comprised of a single component or center section 22 and hollow sections 24 may all be separate components connected together. Center section 22 may have standard hexes for a wrench to grasp. Alternatively, center section 22 may be in any shape that facilitates the entry of conductors into the interior.

Orifice 50 is positioned at tapered end 26 of each hollow section 24 to allow access to internal channel 60 of hollow section 24. Orifice 50 is sized to be slightly larger than conductor 100 to facilitate insertion of conductor 100 into internal channel 60. Orifice 50 and internal channel 60 can be modified when manufactured to accommodate various different sizes of conductors 100.

Male threads 30 are disposed on at least a portion of exterior surface 28 of each hollow section 24. Male threads 30 may be separated into one or more longitudinal sections by at least one longitudinally extending compression groove 40. Compression groove 40 generally extends from orifice 50 to about the edge of center section 22.

In alternative embodiments, connector 10 can comprise additional or alternative components. Connector 10 is illustrated in the figures as being a one-piece component; however, in alternative embodiments connector 10 may be comprised of more than one component. For example as illustrated above, center section 22 may be one component and hollow sections 24 may be separate components that connect to center section 22.

In the embodiments shown in the figures, connector 10 is generally adapted to electrically connect two conductors 100 to each other. However, connector 10 may be adapted to electrically connect more than two conductors to each other. For example, additional tapered hollow sections, each having a compression nut rotatably attached, may be connected to connector to house additional conductors.

Figure 2:
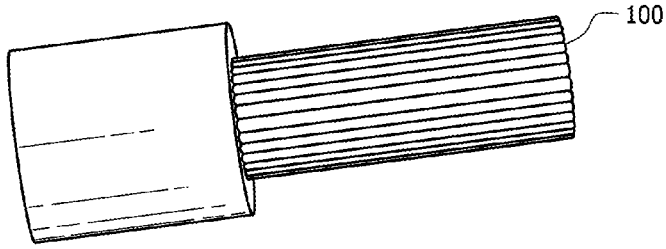
FIG. 2 is a side perspective view of the conductor.

FIG. 2 depicts conductor 100. Conductor 100 may be any material that is capable of conducting electricity, including but not limited to, an electrical wire, a telecom wire, an automotive wire, or an industrial-sized wire. Conductor 100 may come in a variety of sizes and types including, but not limited to, solid and stranded wires.

Figure 3:
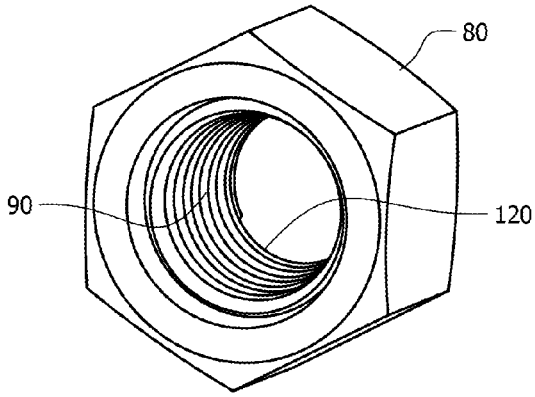
FIG. 3 is a perspective view of the compression nut.

FIG. 3 depicts compression nut 80. Compression nut 80 includes female threads 90 disposed within its interior. In an embodiment, compression nut 80 may include internal taper 120 which is oriented at a matching angle to tapered hollow section 24. In an alternative embodiment, compression lug 80 is not tapered. Compression nut 80 may include standard hexes for a wrench to grasp when assembling and tightening connector 10.

Figure 4:
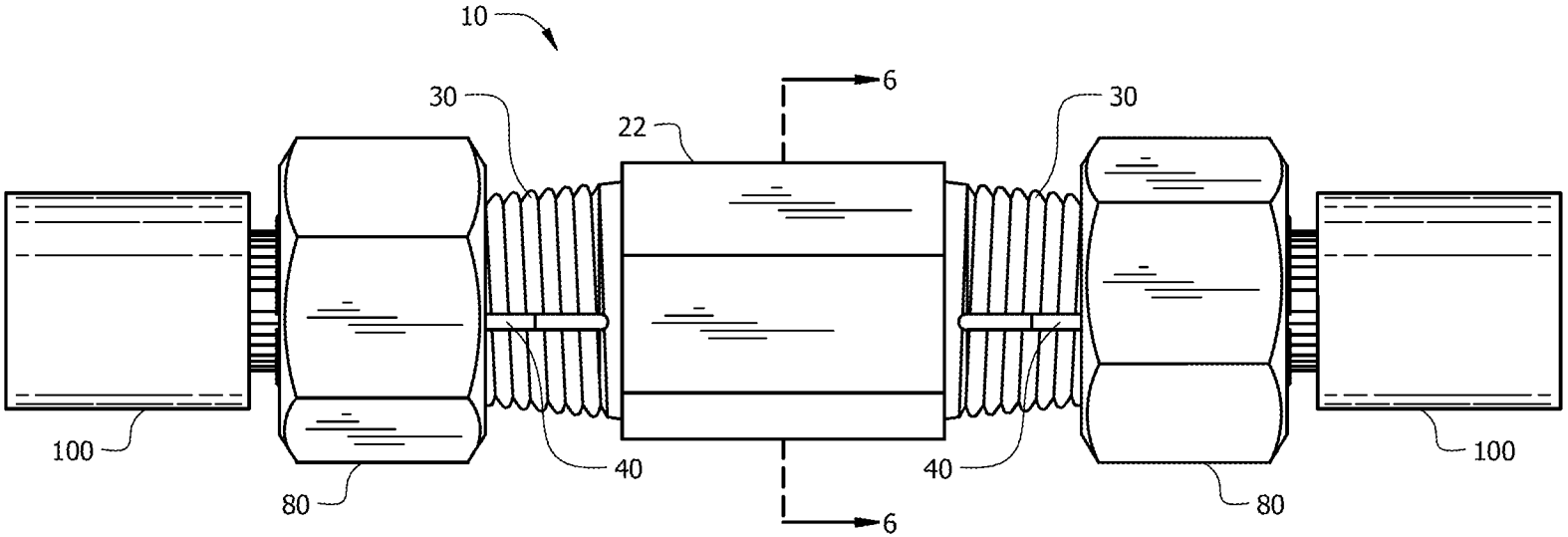
FIG. 4 is a side perspective view of the assembled device.
Figure 5:
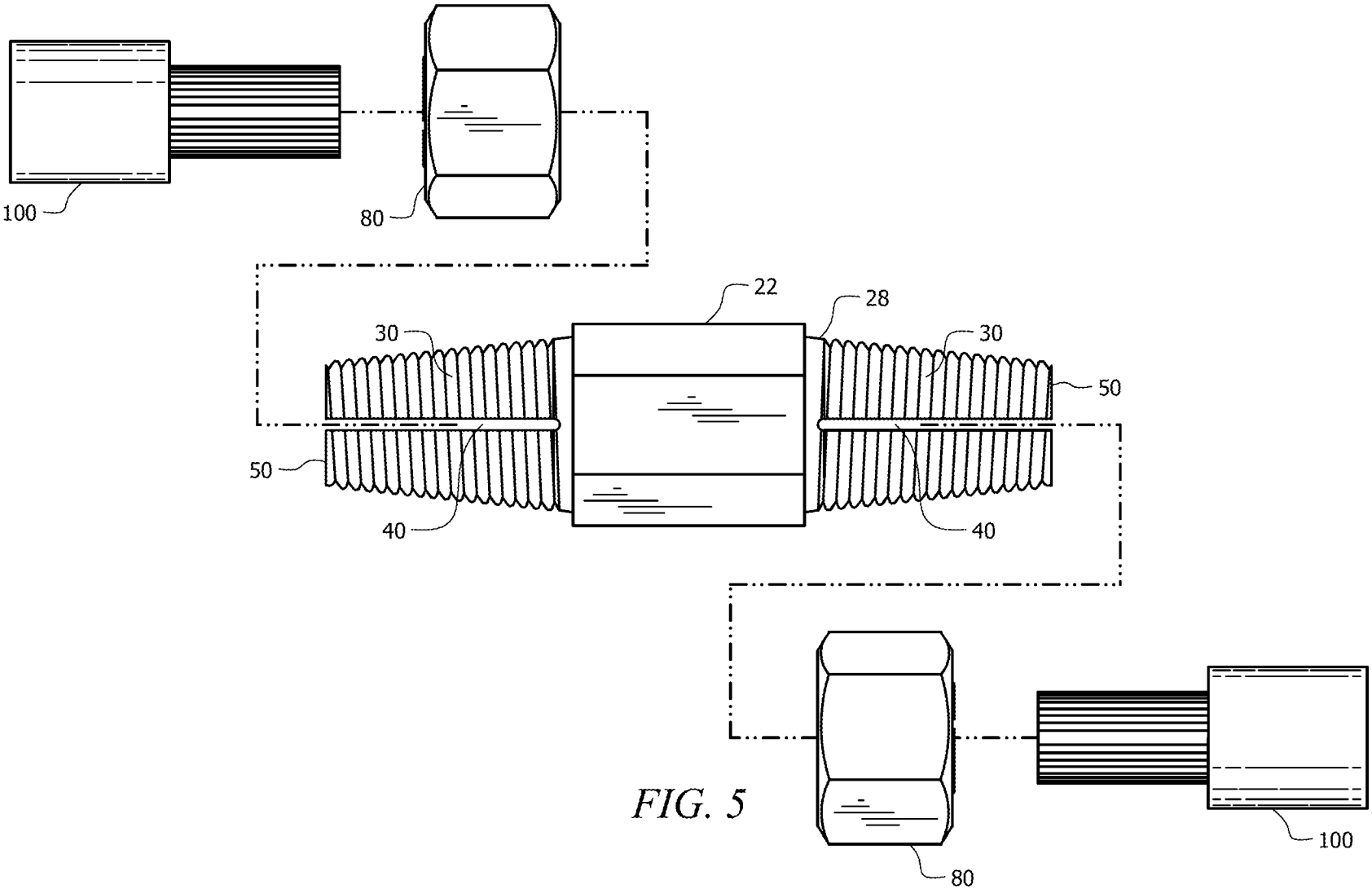
FIG. 5 is an exploded view of the device.

As illustrated in FIGS. 4-5, connector 10 is assembled by threading compression nut 80 onto tapered end 26 of hollow section 24. Conductor 100 is inserted into orifice 50 and advanced down internal channel 60 until it contacts conductor stop 110. Compression nut 80 is then tightened towards center section 22 thus compressing compression grooves 40 together and compressing conductor 100 against connector 10. Depending on the orientation of male threads 30 on hollow section 24 of connector 10, compression nut 80 may be turned clockwise or counter-clockwise in order to tighten compression nut 80 around hollow section 24 of connector 10. The farther down hollow section 24 compression nut 80 is threaded, the greater the compression between connector 10 and conductor 100. Once compression nut 80 is threaded all the way down hollow section 24 and compression grooves 40 are pressed together, conductor 100 is in 360 degree direct contact with connector 10.

Figure 6:
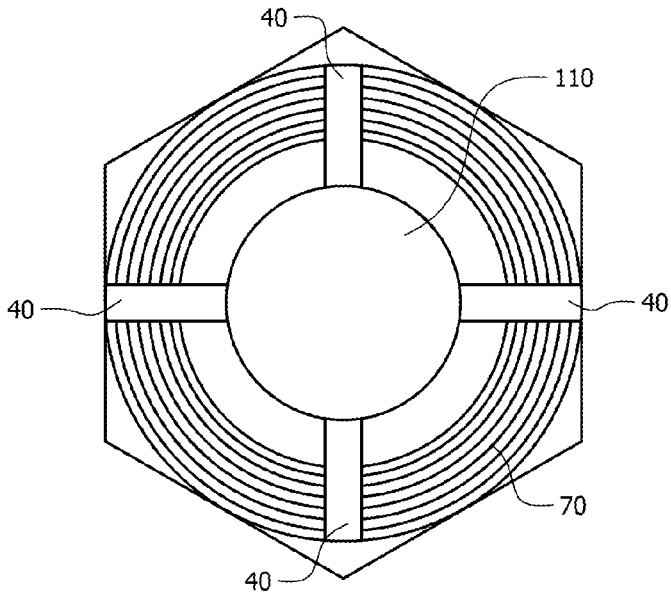
FIG. 6 is a cross-sectional view of the connector taken down the 6-6 line.

FIG. 6 is a cross-sectional image as viewed from orifice 50 and looking down tapered end 26 of hollow section 24. Internal ribs 70 are disposed along internal channel 60 to grip conductor 100. Internal ribs 70 are shown as annular, however they can alternatively be longitudinal. Compression grooves 40 are shown spaced around connector 10. Conductor stop 110 is positioned within center section 22 of connector 10 and serves to contact conductor 100 once inserted. Conductor stop 110 can conduct electricity through conductors 100 inserted in connecter 10 as well as provide structural support to connector 10.

Figure 7:
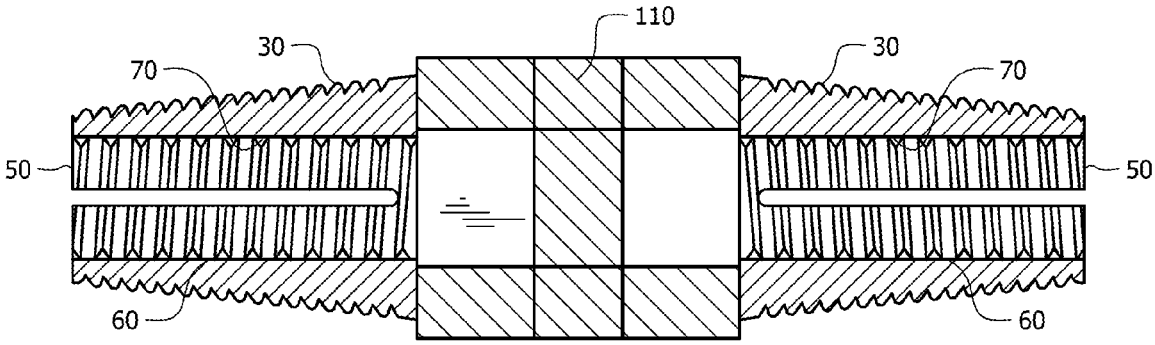
FIG. 7 is a horizontal cross-sectional view of the connector.

As shown in FIG. 7, compression grooves 40 extend from tapered end 26 of each hollow section 24 of connector 10 to slightly before center section 22. Conductor stop 110 is shown in the interior of center section 22. Conductor stop 110 may be positioned substantially centrally within center section 22 so that it may be contacted by each conductor 100. Conductor stop 110 may be of any shape corresponding to the shape of center section 22.

Figure 8:
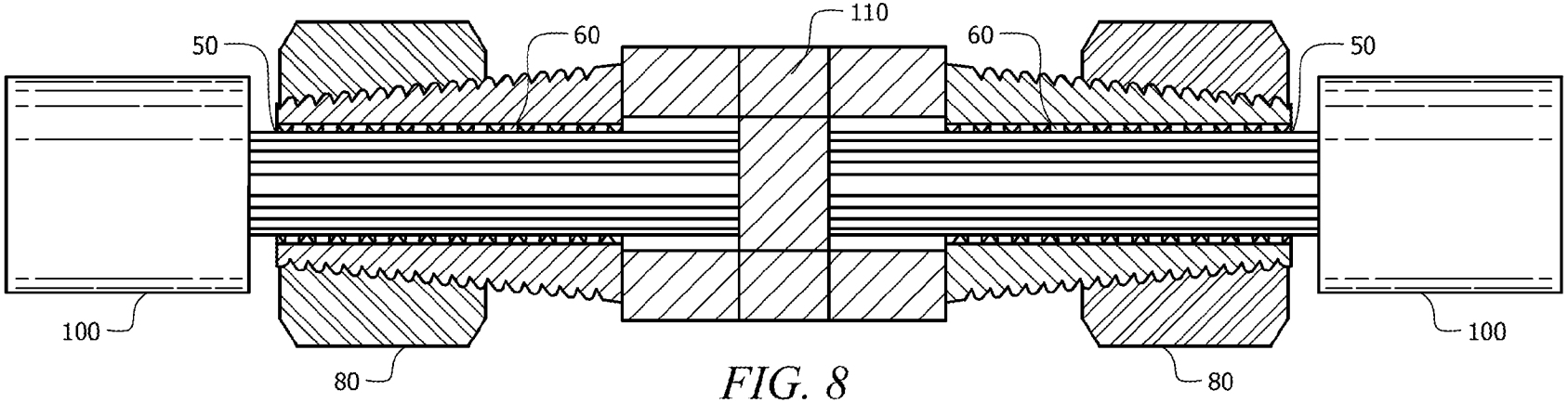
FIG. 8 is a horizontal cross-sectional view of the assembled device.

As shown in FIG. 8, when assembled, conductor 100 is compressed by internal ribs 70 so that conductor 100 is in 360 degree contact with connector 10. Internal ribs 70 act to penetrate conductor 100 when connector 10 is compressed around conductor 100. This penetration provides greater mechanical and electrical contact over the prior art. The present invention allows conductors of differing cross sectional areas to be spliced together since the compression can be adjusted for each conductor.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween. Now that the invention has been described,

What is claimed is:

1. A system for joining electrical conductors comprising:

a connector comprised of an elongated body having a center section and at least two tapering hollow sections each extending from the center section to terminate in a tapered end;

male threads disposed on at least a portion of an exterior surface of the each hollow section;

at least one compression groove disposed on the exterior surface of the tapering hollow sections;

an orifice disposed in each tapered end wherein the orifice is sized slightly larger than each electrical conductor;

an internal channel extending from the orifice;

internal ribs disposed along the internal channel;

at least one conductor stop disposed within the center section of the connector;

at least one compression nut disposed on each of the hollow sections of the connector wherein each compression nut has female threads matching the male threads of the hollow section;

wherein the conductor is inserted into the internal channel of the connector through the orifice until the conductor contacts the conductor stop;

wherein the compression nut is tightened towards the center section to compress the at least one compression groove;

wherein the compression of the at least one compression groove compresses the internal ribs against the conductor to provide 360 degree contact between connector and conductor.

2. The system of claim 1, wherein the at least one compression groove is parallel to the longitudinal axis of the body of the connector; and wherein the compression nut has an internal taper of a matching angle to the tapering hollow sections.

3. The system of claim 1, wherein the internal channel is sized slightly larger than the electrical conductor.

* * * * *

UNITED STATES PATENT AND TRADEMARK OFFICE

CERTIFICATE OF CORRECTION

PATENT NO. : 8,500,497 B1
APPLICATION NO. : 13/711211
DATED : August 6, 2013
INVENTOR(S) : Joseph W. Patten, Jr.

It is certified that error appears in the above-identified patent and that said Letters Patent is hereby corrected as shown below:

Title Page item (71) & (72) should read:

Applicant: Joseph W. Patten, Jr., Odessa, FL (US)

Inventor: Joseph W. Patten, Jr., Odessa, FL (US)

Signed and Sealed this
Seventeenth Day of September, 2013

Teresa Stanek Rea

Teresa Stanek Rea
*Deputy Director of theUnited States Patent and Trademark Office*